US006078131A

United States Patent [19]

McMurray

[11] Patent Number: 6,078,131

[45] Date of Patent: Jun. 20, 2000

[54] SEALING A SPARK PLUG ELECTRODE

[75] Inventor: Mark Stewart McMurray, Toledo, Ohio

[73] Assignee: Cooper Automotive Products, Inc., Houston, Tex.

[21] Appl. No.: 09/133,810

[22] Filed: Aug. 13, 1998

[51] Int. Cl.[7] ..... H01T 13/22

[52] U.S. Cl. ..... 313/145; 445/7

[58] Field of Search ..... 445/7; 313/141, 313/145

[56] References Cited

U.S. PATENT DOCUMENTS

| | | | |
|---|---|---|---|
| 2,680,432 | 6/1954 | Rand | 313/145 |
| 3,940,649 | 2/1976 | Berstler . | |
| 4,097,977 | 7/1978 | Pollner . | |
| 4,563,158 | 1/1986 | Meyer . | |

FOREIGN PATENT DOCUMENTS

| | | | |
|---|---|---|---|
| 0 480 671 A1 | 4/1992 | European Pat. Off. | H01T 21/02 |

*Primary Examiner*—Kenneth J. Ramsey

*Attorney, Agent, or Firm*—Fish & Richardson P.C.

[57] ABSTRACT

An electrode is secured and sealed in an insulator having a bore. The electrode has a shaft and an end plate, with the shaft having a cross section smaller than a cross section of the bore and the end plate having a cross section larger than the cross section of the bore. The shaft of the electrode is inserted into the bore and secured in the bore. A compressive force is applied between the end plate and an opposite end of the electrode, and an electrical current is applied between the end plate and the opposite end of the electrode to heat the electrode while the compressive force is applied. The electrical current and the compressive force are removed after being applied for a time sufficient to heat and expand the electrode so that, upon removing the electrical current, the electrode contracts to establish a seal between the electrode and the insulator.

18 Claims, 7 Drawing Sheets

SEALING A SPARK PLUG ELECTRODE

TECHNICAL FIELD

The invention relates to spark plugs.

BACKGROUND

A conventional spark plug includes an insulator core assembly and an outer shell. A firing electrode extends from the insulator core assembly and a ground electrode extends from the outer shell, with the two electrodes being positioned to define a spark gap. When the spark plug is mounted in an engine, the spark gap is located in the combustion chamber of the engine. The firing electrode, also referred to as the center electrode, extends through a bore of the insulator core assembly and is part of a conduction path between a terminal at one end of the insulator core assembly and the spark gap at the other end.

In the combustion chamber, the pressure varies significantly during operation of the engine. The efficiency of the engine is reduced if there are pressure leaks in the combustion chamber. The spark plug may cause a pressure leak if a good seal is not provided between the center electrode and the insulator core. Conventionally, such a seal may be formed by tamping a powder in the bore between the insulator core assembly and center electrode, or by melting glass particles in the bore.

SUMMARY

In one general aspect, the invention features securing and sealing an electrode in an insulator, such as the insulator of a spark plug. The insulator defines a bore, and the electrode has a shaft and an end plate. The shaft has a cross section smaller than a cross section of the bore, while the end plate has a cross section larger than the cross section of the bore. The shaft of the electrode is inserted into the bore and secured in the bore. Next, a compressive force and an electrical current are applied between the end plate and an opposite end of the electrode to heat the electrode under pressure. After application of the compressive force and electrical current for a time sufficient to heat and expand the electrode, the force and current are removed. The electrode then cools and contracts to establish a seal between the electrode and insulator.

Embodiments may include one or more of the following features. For example, the electrode may be secured by applying an electrical current to a portion of the electrode opposite the end plate to heat the portion of the electrode. Securing the electrode also may include applying a compressive force between the end plate and the opposite end of the electrode. The electrode may be secured by the simultaneous application of the compressive force and electrical current.

A terminal defining a second bore may be placed over the shaft of the electrode at the end of the electrode opposite the end plate, prior to securing the electrode in the first bore. The second bore may extend from a first opening to a second opening that has a cross section larger than a cross section of the first opening, with the first opening positioned adjacent to the insulator. When the electrode is secured, it may fill a volume defined by the second bore.

A thermal compensator may be placed over the electrode, between the terminal and insulator. The thermal compensator defines a third bore and is made of a material having a higher coefficient of thermal expansion than the electrode.

A sealing cement may be placed in the bore around the electrode. The cement seals the electrode to the insulator.

Other features and advantages will be apparent from the following description, including the drawings, and from the claims.

DESCRIPTION

Figure 1D:
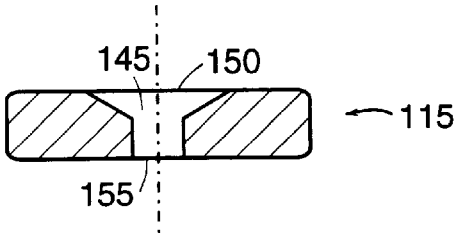
FIG. 1D is a cross-sectional view of a terminal.
Figure 1E:
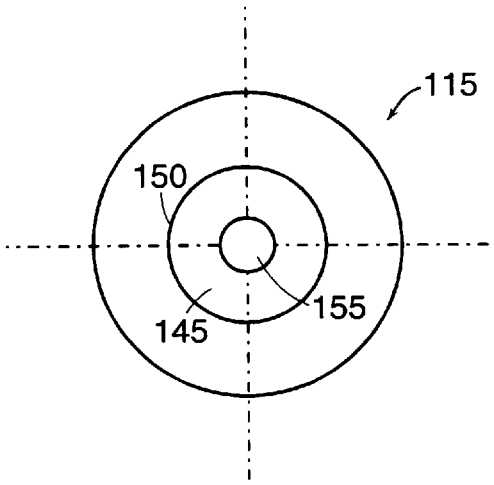
FIG. 1E is a top view of the terminal of FIG. 1D.

Referring to FIGS. 1A–1E, a spark plug insulator core assembly includes an insulator 105, a center electrode 110, and a terminal 115. Insulator 105 defines a straight bore 120 that runs between an electrode opening 125 and a terminal opening 130. Insulator 105 is made of an insulating material, while center electrode 110 is made from a conducting material, such as nickel.

Electrode 110 includes an end plate 135 connected to a shaft 140. End plate 135 is disc-shaped and has a diameter larger than the diameter of bore 120. Shaft 140 has a diameter smaller than the diameter of bore 120.

Terminal 115 is generally disc-shaped and includes a bore 145 that runs between a wider opening 150 and a narrower opening 155. Narrower opening 155 has a diameter larger than the outer diameter of shaft 140.

Figure 1F:
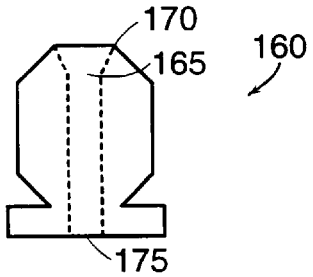
FIG. 1F is a cross-sectional view of a solid terminal.
Figure 1A:
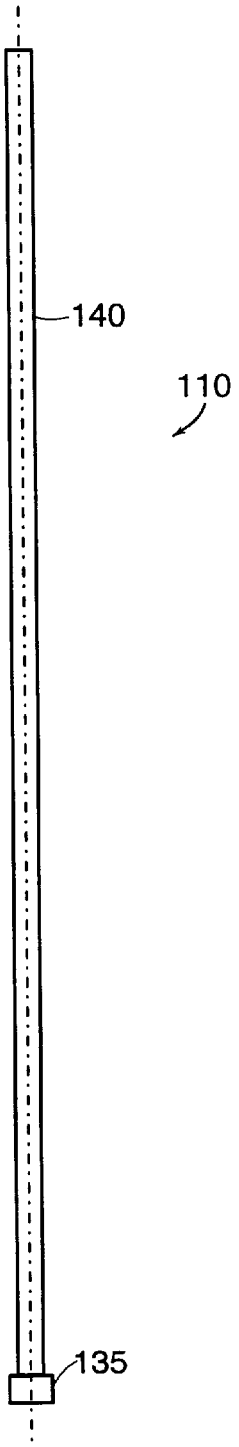
FIG. 1A is a front view of a center electrode.
Figure 1B:
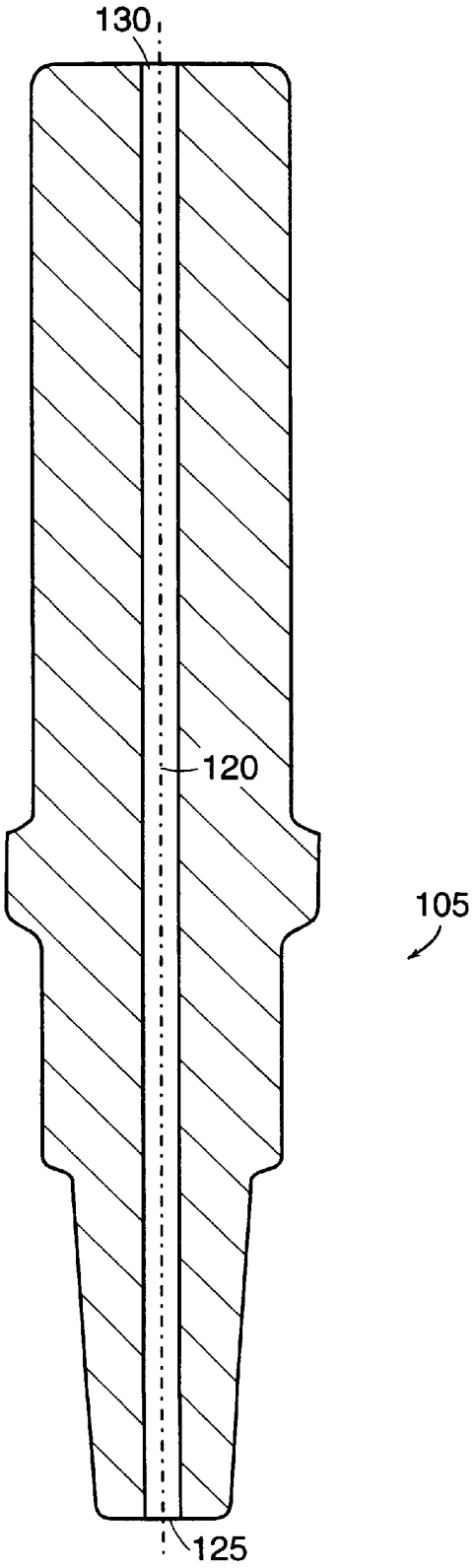
FIG. 1B is a cross-sectional view of an insulator.
Figure 1C:
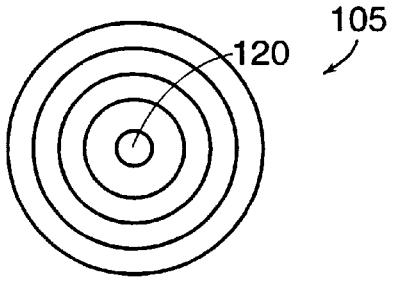
FIG. 1C is a bottom view of the insulator of FIG. 1B.

Referring to FIG. 1F, terminal 115 may be replaced by an extended terminal 160. Terminal 160 includes a bore 165 that runs between a wider opening 170 and a narrower opening 175. Bore 165 and opening 175 have the same diameter, which is larger than the outer diameter of shaft 140. Wider opening 170 has a diameter similar to the diameter of wider opening 150 of terminal 115.

Figure 2:
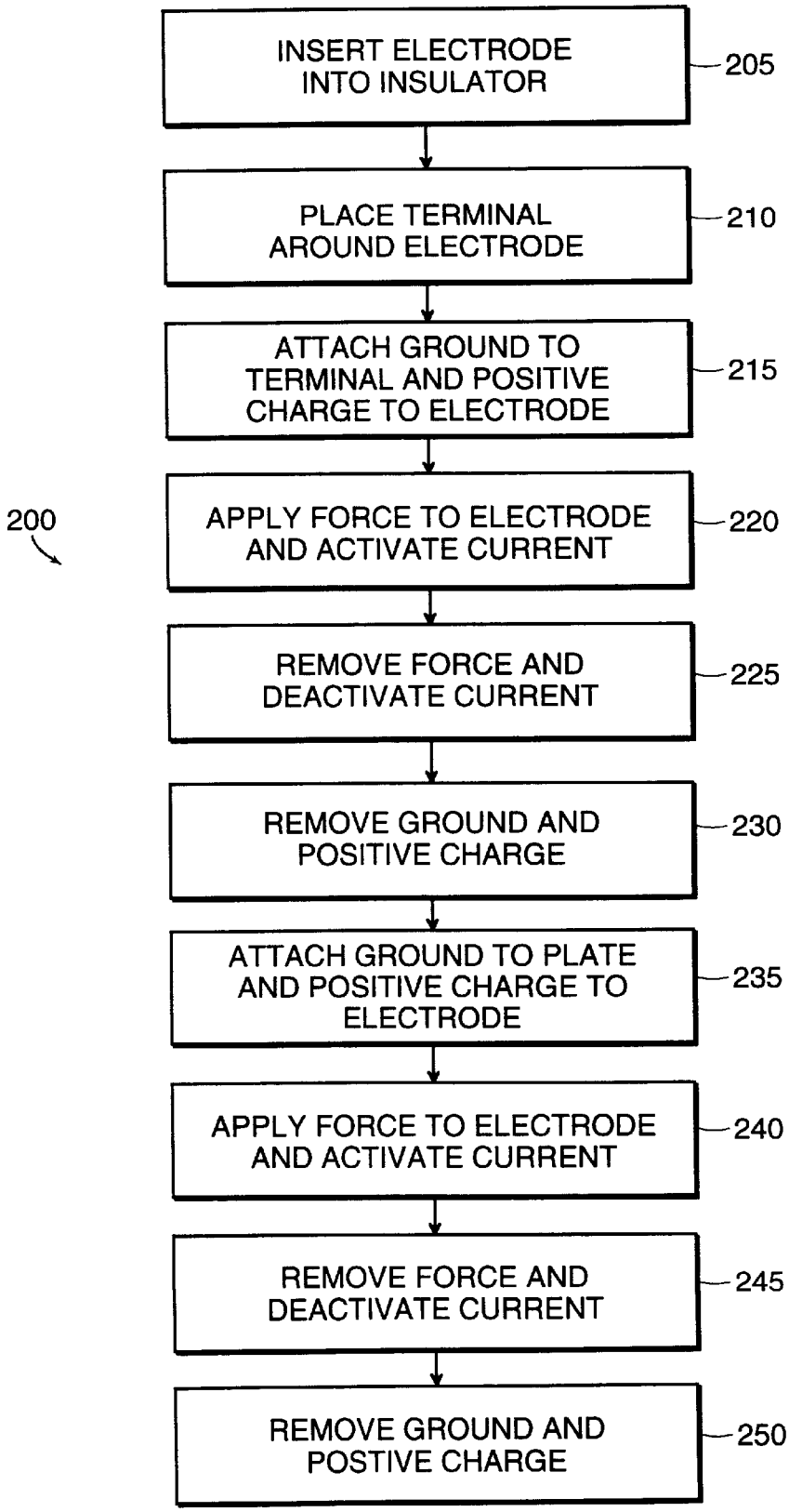
FIG. 2 is a flow chart illustrating the process of locking and sealing the center electrode in an insulator.

Center electrode 110 is locked and sealed within insulator 105 according to a procedure 200 illustrated in FIG. 2. First, shaft 140 is inserted into electrode opening 125 of insulator 105 (step 205). Center electrode 110 is pushed into and through bore 120 until end plate 135 rests against insulator 105. Because shaft 140 is longer than bore 120, a length of shaft 140 extends beyond opening 130. Terminal 115 is placed around shaft 140 so that narrower opening 155 is adjacent to insulator 105 and shaft 110 extends beyond opening 150 (step 210). In other implementations, a terminal 160 may be placed around shaft 140 so that narrower opening 175 is adjacent to insulator 105 and shaft 140 extends beyond opening 170.

Figure 3:
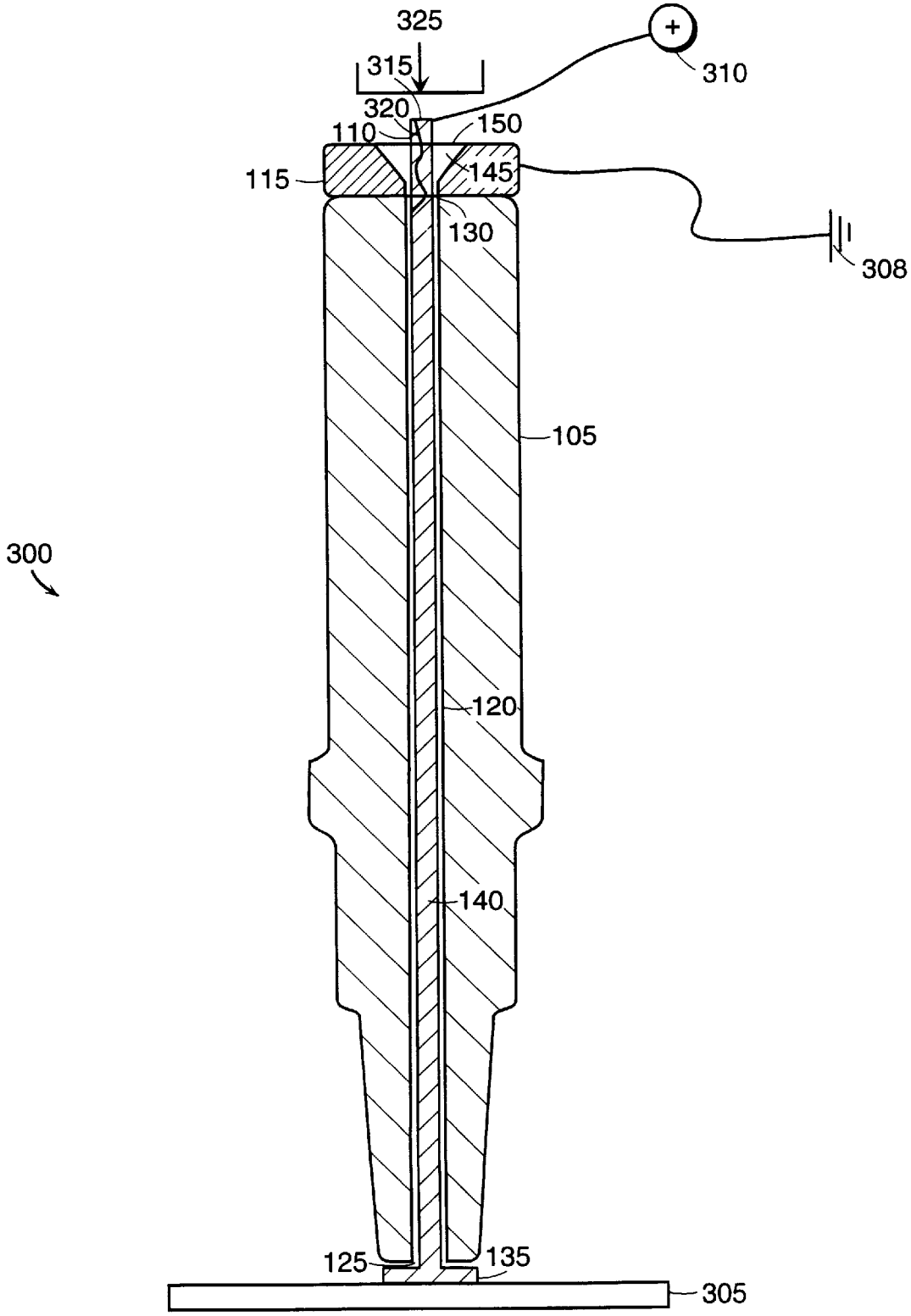
FIGS. 3 and 4 are cross-sectional views of an insulator core assembly during different steps of the process of FIG. 2.

As shown in FIG. 3, the end plate 135 is supported by a surface 305 that is not electrically conductive, so that surface 305 will not function as an electrical ground. Then a circuit is formed by connecting terminal 115 to electric ground 308 and connecting a positive electrical terminal 310 to the end 315 of electrode 110 (step 215). The polarity can be reversed without any effect on the product. Upon activation, the electric circuit formed in this manner causes an electrical current to flow through end 315 and terminal 115. The electrical current heats end 315, a length 320 of shaft 110, and terminal 115. Upon application of sufficient current, the heat softens or melts length 320 so that the softened or melted electrode material fills bore 145 (step 220). Simultaneous with application of the current, a press 325 applies a compressive force to electrode end 315 to compress the softened or melted length 320 into bore 145. The press may serve as the positive terminal 310.

After the softened or melted electrode material fills bore 145, the electrical current is deactivated and the compressive force is removed (step 225). The connections to ground and the positive charge are then removed (step 230).

Figure 4:
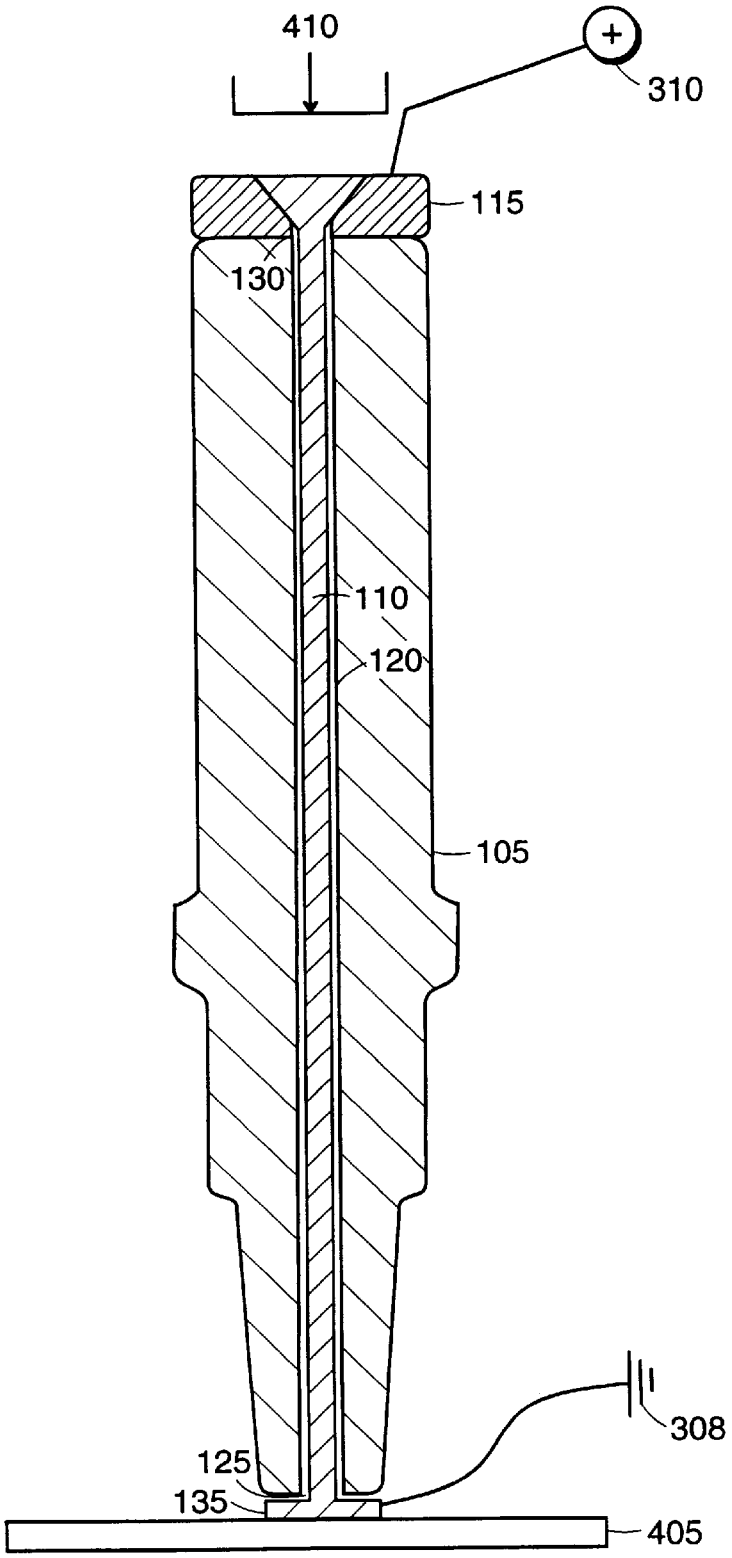

As illustrated in FIG. 4, the electrode 110 then is sealed into insulator 105. Positive electrical terminal 310 is connected to terminal 115 and electrical ground 308 is connected to end plate 135 (step 235). As above, the polarity can be reversed without any effect on the product.

Insulator 105 and electrode 110 are supported by a surface 405 that may serve as electrical ground. A press 410, which may serve as the positive terminal, applies a compressive force to electrode 110 while current flows through electrode 110 (step 240). The current heats the entirety of electrode 110 and, in response to the heat, electrode 110 expands. Because the expansion of the electrode 110 is restricted in the longitudinal direction by the force between surface 405 and press 410, the electrode deforms laterally, filling bore 120 and closing gaps between the electrode and openings 125 and 130. After the electrode is heated sufficiently, the current is turned off (step 245). Application of force by press 410 may continue for a longer period until electrode 110 is cooler and becomes more rigid. As electrode 110 cools, it contracts, further ensuring leak-proof seals between electrode 110 and openings 125 and 130. The press and any other electrical connections then are removed (step 250).

In other implementations, terminal 160 may be used in place of terminal 115. Depending upon the size of terminal 160, shaft 140 of center electrode 105 may be longer to ensure that a length of shaft 140 extends beyond opening 170 and includes sufficient material to fill opening 170 when current and force are applied.

Figure 5B:
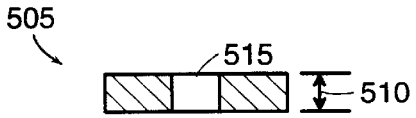
FIG. 5B is a cross-sectional side view of the thermal compensator of FIG. 5A.
Figure 5C:
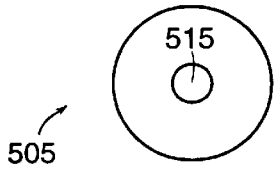
FIG. 5C is a bottom view of the thermal compensator of FIG. 5B.
Figure 5A:
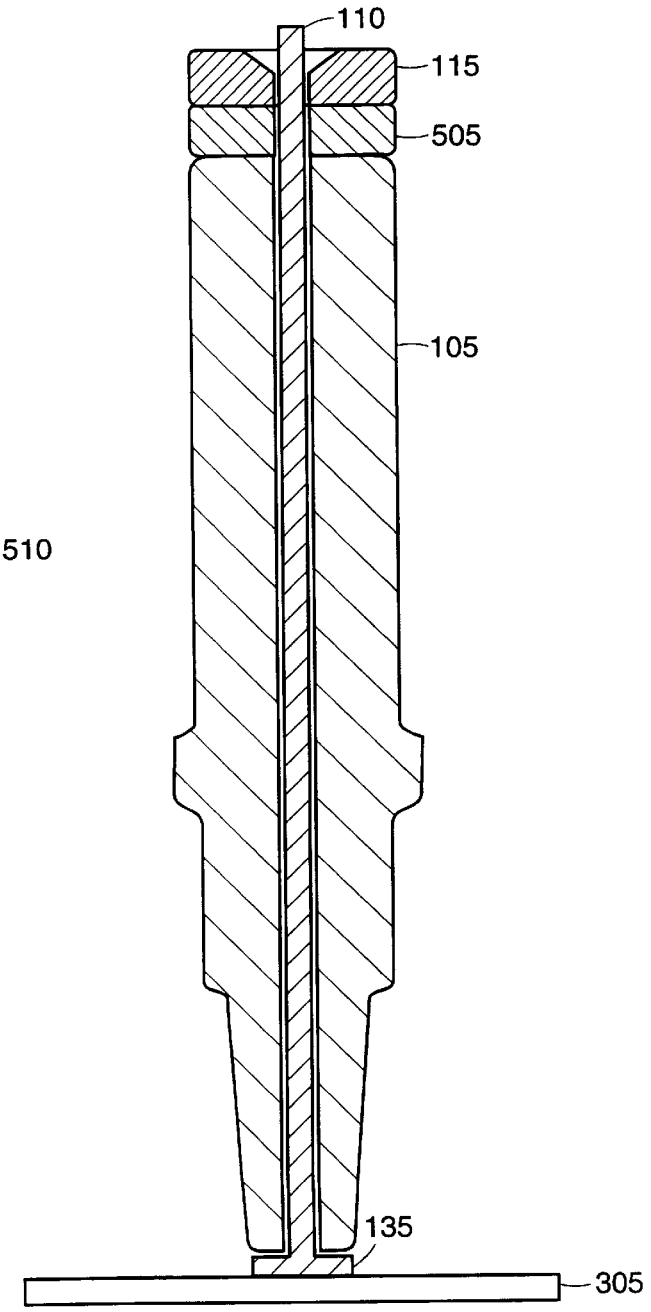
FIG. 5A is a cross-sectional view of an insulator core assembly having a thermal compensator.

Referring to FIGS. 5A–5C, another implementation may include use of a thermal compensator 505 positioned between terminal 115 and insulator 105, and having a thickness 510. Compensator 505 includes a bore 515 which is placed around shaft 140. Compensator 505 is made of a material with a higher thermal expansion coefficient than the electrode material. Because compensator 505 has a higher thermal expansion coefficient, during use in an engine the compensator 505 will expand more than the electrode so as to maintain a seal between insulator 105, electrode 110, and compensator 505. The thickness 510 may be varied to determine total thermal compensation. In this implementation, the electrode is locked and sealed in the insulator in the manner described above with respect to FIG. 2.

Figure 6A:
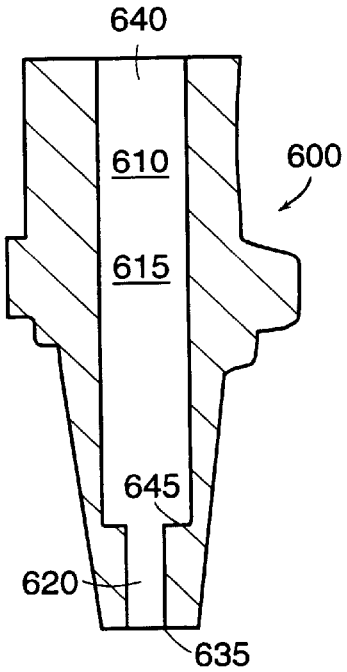
FIG. 6A is a cross-sectional view of an insulator for internal termination of a center electrode seal.
Figure 6B:
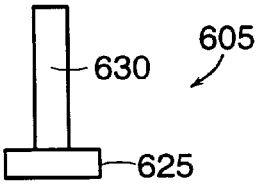
FIG. 6B is a front view of a short center electrode.
Figure 6C:
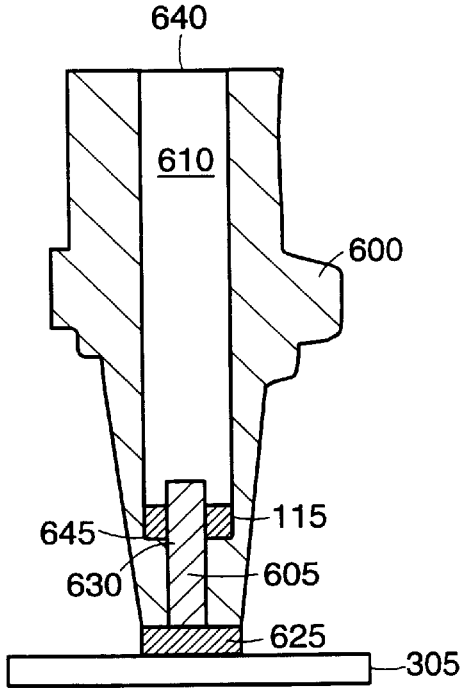
FIG. 6C is a cross-sectional view of an insulator having a short center electrode.

Referring to FIGS. 6A–6C, a center electrode seal may be implemented using an insulator 600, a short center electrode 605, and terminal 115. In this implementation insulator 600 defines a bore 610 having a larger diameter section 615 and a smaller diameter section 620. Center electrode 605, having an end plate 625 and a shaft 630, is inserted into an opening 635 of insulator 600. Shaft 630 is inserted into bore 610 until end plate 625 is adjacent to opening 635 and shaft 630 extends beyond smaller diameter section 620. Shaft 630 has a smaller diameter than the diameter of section 620 of bore 610. Electrode 605 and insulator 600 are supported by surface 305.

Terminal 115 is inserted into an opening 640 of insulator 600. Opening 640 and larger diameter section 615 have a diameter larger than the outer diameter of terminal 115. Terminal 115 is passed over shaft 630 until it rests against a shoulder 645 defined by the junction between sections 615 and 620. The electrode 605 is then locked and sealed within insulator 600 as described above.

Figure 7:
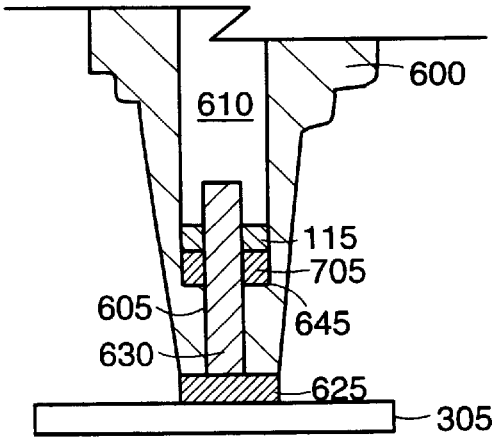
FIG. 7 is a cross-sectional view of the insulator core assembly of FIG. 6C having a thermal compensator.

Referring to FIG. 7, in another implementation a thermal compensator 705 may be placed between shoulder 645 and terminal 115 to improve the seal during high temperature applications. The electrode is locked and sealed within the insulator 600 using the procedure described above.

To further improve the seal in the implementations described above, a cement or epoxy may be placed around the electrode in bore 610. The cement or epoxy improves the seals during high temperature applications.

Also in the above implementations, a capsule suppressor may be placed in bore 610 between terminal 115 and an additional terminal (not shown) inserted at opening 640 to reduce electrical noise.

In other implementations, the firing end of the center electrode may be covered with a precious metal (e.g., platinum) pad.

What is claimed is:

1. A method of securing and sealing an electrode in an insulator, the method comprising;

providing an insulator defining a bore;

providing an electrode having a shaft and an end plate, the shaft having a cross section smaller than a cross section of the bore and the end plate having a cross section larger than the cross section of the bore;

inserting the shaft of the electrode into the bore;

securing the electrode in the bore;

applying a compressive force between the end plate and an opposite end of the electrode;

applying an electrical current between the end plate and the opposite end of the electrode to heat the electrode while the compressive force is applied;

removing the electrical current; and removing the compressive force;

wherein the compressive force and electrical current are applied for a time sufficient to heat and expand the electrode so that, upon removal of the electrical current, the electrode contracts to establish a seal between the electrode and the insulator.

2. The method of claim 1, wherein securing the electrode comprises applying an electrical current to a portion of the electrode opposite the end plate to heat the portion of the electrode.

3. The method of claim 2, wherein securing the electrode further comprises applying a compressive force between the end plate and the opposite end of the electrode.

4. The method of claim 3, wherein the electrode is secured by the simultaneous application of the compressive force and electrical current.

5. The method of claim 1, wherein prior to securing the electrode in the first bore, a terminal defining a second bore is placed over the shaft at the end of the electrode opposite the end plate.

6. The method of claim 5, wherein the second bore extends from a first opening to a second opening, the second opening has a cross section larger than a cross section of the first opening, and the first opening is positioned adjacent to the insulator.

7. The method of claim 5, wherein the secured electrode fills a volume defined by the second bore.

8. The method of claim 5, further comprising placing a thermal compensator over the electrode between the terminal and insulator, wherein the thermal compensator defines a third bore and is made of a material having a higher coefficient of thermal expansion than the electrode.

9. An insulator having a bore and an electrode secured and sealed in the bore according to the method of claim 1.

10. An insulator having a bore and an electrode secured and sealed in the bore according to the method of claim 2.

11. A spark plug having an insulator defining a bore and an electrode having a shaft and an end plate, the shaft having a cross section smaller than a cross section of the bore and the end plate having a cross section larger than the cross section of the bore, the spark plug being made by:

inserting the shaft of the electrode into the bore;

securing the electrode in the bore;

applying a compressive force between the end plate and an opposite end of the electrode;

applying an electrical current between the end plate and the opposite end of the electrode to heat the electrode while the compressive force is applied;

removing the electrical current; and removing the compressive force;

wherein the compressive force and electrical current are applied for a time sufficient to heat and expand the electrode so that, upon removal of the electrical current, the electrode contracts to establish a seal between the electrode and the insulator.

12. The spark plug of claim 11, wherein the electrode is secured by applying an electrical current to a portion of the electrode opposite the end plate to heat the portion of the electrode.

13. The spark plug of claim 12, wherein the electrode is secured by applying a compressive force between the end plate and the opposite end of the electrode.

14. The spark plug of claim 13, wherein the electrode is secured by the simultaneous application of the compressive force and electrical current.

15. The spark plug of claim 11, further comprising a terminal defining a second bore, wherein, prior to securing the electrode in the first bore, the terminal is placed over the shaft at the end of the electrode opposite the end plate.

16. The spark plug of claim 15, wherein the second bore extends from a first opening to a second opening, the second opening has a cross section larger than a cross section of the first opening, and the first opening is positioned adjacent to the insulator.

17. The spark plug of claim 15, wherein the secured electrode fills a volume defined by the second bore.

18. The spark plug of claim 15, further comprising a thermal compensator defining a third bore and made of a material having a higher coefficient of thermal expansion than the electrode, the thermal compensator being placed over the electrode between the terminal and insulator.

* * * * *